US007891510B2

(12) United States Patent
Loughrin et al.

(10) Patent No.: US 7,891,510 B2
(45) Date of Patent: Feb. 22, 2011

(54) CONTAINER CLOSURE ASSEMBLY

(75) Inventors: Thomas D. Loughrin, Columbus, OH (US); Kristi L. Rogers, Sunbury, OH (US); Elwood L. Stokesbury, Galena, OH (US)

(73) Assignee: Abbott Laboratories, Abbott Park, IL (US)

( * ) Notice: Subject to any disclaimer, the term of this patent is extended or adjusted under 35 U.S.C. 154(b) by 439 days.

(21) Appl. No.: 11/955,181

(22) Filed: Dec. 12, 2007

(65) Prior Publication Data

US 2008/0264894 A1 Oct. 30, 2008

Related U.S. Application Data

(63) Continuation-in-part of application No. 11/645,425, filed on Dec. 26, 2006, now abandoned.

(51) Int. Cl.
*B65D 51/00* (2006.01)
*B65D 41/32* (2006.01)

(52) U.S. Cl. ..... 215/252; 220/266

(58) Field of Classification Search ..... 215/254, 215/258, 44, 43, 337, 330, 40, 200, 316; 220/266, 265, 260, 298, 296; D9/518
See application file for complete search history.

(56) References Cited

U.S. PATENT DOCUMENTS 4,349,116 A 9/1982 Luenser (Continued)

FOREIGN PATENT DOCUMENTS

EP 864504 A1 9/1998

(Continued)

OTHER PUBLICATIONS

Davis, Options in Flexible and Rigid Packaging Are Changing Food Production Criteria, Packing Materials, Construction and Design Increasing Food Quality and Extended Shelf Life. Articles [online]. ToP Inc., 2007 [retrieved on Oct. 22, 2008] Retrieved from the internet: <http://www.idspackaging.co.in/packaging/india/White_Paper_Flexible_Rigid_Packaging/54/paper_information.html>, pp. 1-3.

(Continued)

*Primary Examiner*—Anthony Stashick
*Assistant Examiner*—Robert J Hicks
(74) *Attorney, Agent, or Firm*—William J. Winter

(57) ABSTRACT

An assembly includes a container and a closure. The closure includes a tamper-indicating band having a plurality of sloping teeth. Each of the sloping teeth of the tamper-indicating band has an engagement surface that is engageable with one of the engagement surfaces of the sloping teeth of the container. The sloping teeth on the tamper-indicating band are configured such that when one of the teeth on the tamper-indicating band completely engages one of the teeth on the exterior surface of the neck of the container, the engagement surface of at least one of the other sloping teeth on the tamper-indicating band is free from engagement with the engagement surfaces of the sloping teeth of the container and the engagement surface of at least one of the other sloping teeth of the container is free from engagement with the engagement surfaces of the sloping teeth on the tamper-indicating band.

15 Claims, 5 Drawing Sheets

U.S. PATENT DOCUMENTS

| | | | | |
|---|---|---|---|---|
| 4,694,970 | A | 9/1987 | Hayes | |
| 4,785,963 | A | 11/1988 | Magley | |
| 4,813,561 | A | 3/1989 | Ochs | |
| 4,880,127 | A | 11/1989 | Doi | |
| 4,903,849 | A * | 2/1990 | Wallman | 215/256 |
| 4,981,230 | A | 1/1991 | Marshall et al. | |
| 4,991,731 | A | 2/1991 | Osip et al. | |
| 5,004,110 | A | 4/1991 | Osip et al. | |
| 5,040,692 | A | 8/1991 | Julian | |
| 5,042,226 | A | 8/1991 | Osip et al. | |
| 5,100,011 | A * | 3/1992 | Maietta | 215/256 |
| 5,217,737 | A | 6/1993 | Gygax et al. | |
| 5,292,019 | A * | 3/1994 | Patterson | 215/256 |
| 5,307,945 | A * | 5/1994 | Hidding et al. | 215/329 |
| 5,346,082 | A | 9/1994 | Ochs et al. | |
| 5,553,727 | A * | 9/1996 | Molinaro | 215/44 |
| 5,593,055 | A * | 1/1997 | Repp et al. | 215/256 |
| 6,276,543 | B1 | 8/2001 | German et al. | |
| 6,296,130 | B1 | 10/2001 | Forsyth et al. | |
| 6,325,227 | B1 * | 12/2001 | Ekkert | 215/252 |
| 2002/0134747 | A1 * | 9/2002 | Babcock et al. | 215/252 |
| 2003/0160020 | A1 | 8/2003 | Oh | |
| 2005/0090183 | A1 | 4/2005 | Himmer | |

FOREIGN PATENT DOCUMENTS

| | | | |
|---|---|---|---|
| WO | 0069742 | | 11/2000 |
| WO | 0115988 | A1 | 3/2001 |
| WO | 2005090183 | A1 | 9/2005 |

OTHER PUBLICATIONS

Kuntz, In the Can: A Look at Retorting. Articles [online]. Food Product Design, Virgo Publishing, Aug. 1,1994 [retrieved on Oct. 22, 2008] Retrieved from the internet: <URL: http://www.foodproductdesign.com/ articles/462/462__0894de.html>, pp. 1-8.

European Patent Office, International Search Report, Aug. 11, 2008.

* cited by examiner

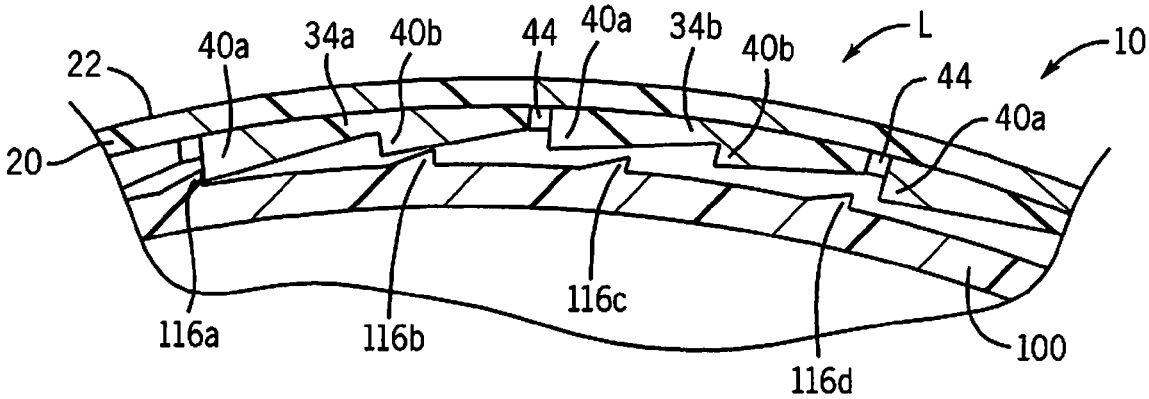
FIG. 6
FIG. 7
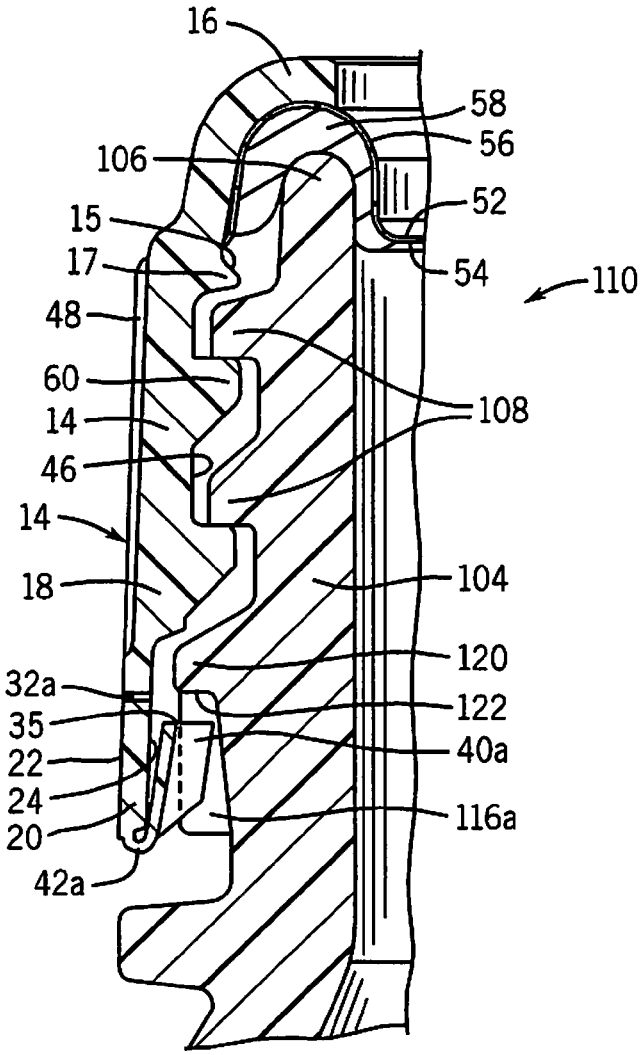

CONTAINER CLOSURE ASSEMBLY

The present application is a continuation-in-part of U.S. patent application Ser. No. 11/645,425 filed Dec. 26, 2006 now abandoned, entitled "CONTAINER CLOSURE ASSEMBLY". The above-referenced application is incorporated by reference as if fully set forth herein.

BACKGROUND OF THE INVENTION

1. Field of the Invention

This invention provides an easy to open container/closure assembly, more particularly, an easy to open closure/container assembly having a tamper-indicating feature.

2. Discussion of the Art

Two main types of bottle/closure systems that utilize breakaway bands for indicating tampering are currently commercially available. Both types have certain drawbacks. The first type locks the tamper-indicating band in place. This locking mechanism requires simultaneous application of two of forces: (1) the force to overcome thread and sealing surface friction to remove the cap and (2) the force to break the tamper resistance band, thereby resulting in high removal torques and high standard deviations of removal torque. The lowest removal torque that can be achieved with this system is approximately 18 inch pounds on average. This force is too high for elderly users and users suffering from arthritis. The second type involves the separation of the opening force from the force required to remove the tamper-indicating band, by allowing approximately 180° of free rotation of the cap before breakage of the tamper band is initiated. Accordingly, the closure is subject to substantial "back-off" (i.e. loosening) and possible leakage during distribution. This type of closure also does not provide any audible feedback in the area between cap opening and band breakage to reassure the consumer of safety. In both of these types of tamper resistance mechanisms, the force that breaks away the tamper resistant band is angular or circumferential and is applied by the torque of removing the closure.

U.S. Pat. No. 4,991,731 describes problems encountered when packaging consumable products in sealed containers. These problems are described below.

Due to concerns about material cost, container weight, and breakage, suppliers of consumable products desire to manufacture the container from a plastic substance, such as polypropylene, which is relatively inexpensive and may be colored or translucent. A problem arises when attempting to provide a cap for a plastic container, wherein the cap maintains a hermetic seal. Because it is difficult to maintain a hermetic seal in a plastic container, and conventional metal caps and plastic containers expand by a dissimilar amount, metal caps, by themselves, do not maintain a hermetic seals consistently on plastic containers when subjected to retort conditions.

During thermal treatment such as retort conditions, heat causes polymer relaxation or shrinkage, especially in the upper neck portion of the container. Injection or extrusion molded plastic bottles are formed by melting and pressure forming, which create stress and memory in the molecules of the polymer. The introduction of heat during the retort process causes those molecules to relax, so as to actually shrink the diameter of the neck portion of the container. This shrinkage causes severe problems in maintaining a conventional metal cap on a plastic bottle. This shrinkage may also prevent the use of a conventional plastic cap with a plastic bottle.

The problems mentioned above can be overcome by applying a substantial amount of torque when initially capping the bottle. However, the amount of torque necessary to maintain a conventional cap on a plastic bottle is so high that a person would not be able to easily twist the cap off the bottle following retort. Other alternatives would be to use an extremely expensive plastic to fabricate the bottle so that the plastic would not shrink at retort temperatures and could maintain an internal vacuum without distortion.

Screw on bottle caps have a tendency to loosen from a tightened condition on a threaded bottle neck finish. This tendency to loosen is often referred to as "back off". This tendency to loosen has a number of causes, including, for example, temperature change, creep in the bottle and cap materials, relaxation of a liner or sealant material, and vibration during handling and shipping. This problem is more frequently encountered when the screw threads have a high pitch to enable the cap to be quickly removed and reinstalled with limited twisting action. Loose caps create problems for the manufacturer and retailer of packaged goods and even for the ultimate user. Loose caps can falsely indicate tampering, and, of course, allow spillage or leakage of the contents as well as entrance of contaminants into the container. A good moisture seal is especially important, for example, when pharmaceuticals and dietary supplements can be adversely affected by excess increases of or by excess decreases of moisture content. While "anti-back off" features are known in the industry, these features have not generally been available for bottles intended for use by elderly persons having limited strength and by sufferers from arthritis.

U.S. Pat. No. 6,296,130, EP 0 864 504 A1, WO 01/15988 A1, U.S. Patent Application Publication 2003/0160020 A1, and U.S. Pat. No. 4,349,116 disclose closure/container assemblies having "anti-back off" features. It is apparent that there is a need for an improved container/closure assembly that provides system seal integrity during retort, as well as permitting the sanitary opening of the container in a single action motion with a very low removal torque.

U.S. Pat. No. 4,813,561 describes containers and closures having tamper resistance bands. This patent describes ratchet teeth on a closure and sets of corresponding teeth on the container that engage below a retaining ledge. The sets of teeth on the container create gaps or spaces into which the tamper band can deform upon opening. However, due to the exact correspondence and alignment of the ratchet teeth on the container and closure, significant torque is still needed to break the tamper band bridges and remove the closure.

SUMMARY OF THE INVENTION

This invention provides a closure that addresses the afore-described disadvantages of container/closure systems that are currently commercially available. In one embodiment of the invention, and assembly comprises a container and a closure, wherein said container has a neck, said neck having an interior surface, an exterior surface substantially curved about an axis, said interior and exterior surfaces joining at an opening of said neck, said exterior surface having (a) at least one thread, (b) a plurality of sloping teeth directed radially outwardly, and (c) a retaining bead positioned axially between said threads and said teeth; and said closure has (a) a top wall; (b) a side wall defining an interior surface substantially curved about an axis, an exterior surface, an upper portion, and a lower portion; (c) at least one thread on the interior surface of said side wall adapted to mate with said thread on the neck of said container; (d) a tamper-indicating band having an interior surface, an exterior surface, an upper edge, and a lower edge, the upper edge of said tamper indicating band attached to the lower portion of said closure side wall by a plurality of rupturable bridges; and said tamper-indicating band further having a plurality of sloping teeth directed radially inwardly toward the sloping teeth on the neck of the container; wherein at least one tooth on the tamper indicating band engages at least one tooth on the exterior surface of the neck of the container, and wherein subsequent teeth on the tamper indicating band are angularly offset with respect to the teeth on the exterior surface of the neck of the container.

In one embodiment, the sloping teeth on the tamper-indicating band are formed on a radially outwardly facing exterior surface of a plurality of tabs depending downwardly from the lower edge of the tamper indicating band, said tabs being connected to said lower edge by means of a hinge such that the sloping teeth on outwardly facing exterior surface of the tab can be folded into a radially inwardly facing position. A side wall of these teeth, once folded inwardly, provide an upward-facing surface that engages the retaining band upon removal of the closure, in order to resist upward motion of the upper portion of the closure as it is torqued off the neck of the container. As the closure lifts off, the tamper indicating band—by interference fit of the teeth against the retaining bead, not by full engagement of the sloping teeth—is axially restrained from moving upward with the rest of the closure. This applies a stretching force on the rupturable bridges and eventually breaks them, leaving the tamper indicating band retained around the neck of the container. The interference fit of the side wall surface of the teeth with the underside of the retaining bead is preferably facilitated if at least one of the retaining bead or the upward facing side wall surface are continuous around the circumference: the retaining bead may be annular and continuous against separated teeth, or the side wall of the teeth—joined by connectors if teeth are formed on separate downwardly depending tabs—may form a continuous surface against a discontinuous retaining bead.

It may be preferable to form the sloping teeth of the closure on the exterior surface of downwardly depending tabs that are folded inwardly against the interior of the tamper indicating band, such that the sloping teeth now face radially inwardly, i.e. toward the axis of the closure. Alternatively, the teeth may be molded into the interior surface of the tamper indicating band, or formed on a separate ring that is fastened to the interior of the tamper indicating band. The teeth of the closure face the opposite direction as the teeth of the container, such that the tooth faces engage.

Methods are also described for providing the components of the assembly, and for using the assembly. For example, a method for a providing container-closure assembly, comprises providing a container having a neck, said neck having an interior surface, an exterior surface substantially curved about an axis, said interior and exterior surfaces joining at an opening of said neck, said exterior surface having (a) at least one thread, (b) a plurality of sloping teeth directed radially outwardly, and (c) a retaining bead positioned axially between said threads and said teeth; for use with a closure having (a) a top wall; (b) a side wall defining an interior surface substantially curved about an axis, an exterior surface, an upper portion, and a lower portion; (c) at least one thread on the interior surface of said side wall adapted to mate with said thread on the neck of said container; (d) a tamper-indicating band having an interior surface, an exterior surface, an upper edge, and a lower edge, the upper edge of said tamper indicating band attached to the lower portion of said closure side wall by a plurality of rupturable bridges; and said tamper-indicating band further having a plurality of sloping teeth directed radially inwardly toward the sloping teeth on the neck of the container;

wherein the providing step includes a step of ensuring that at least one tooth on the tamper indicating band engages at least one tooth on the exterior surface of the neck of the container, and that teeth are placed on the container such that subsequent teeth on the neck of the container are angularly offset with respect to the teeth on the tamper indicating band.

Further details of the container or closure as describe herein may be used in this method.

An alternative method for providing container-closure assembly, comprises:

providing, for use with a container having a neck, said neck having an interior surface, an exterior surface substantially curved about an axis, said interior and exterior surfaces joining at an opening of said neck, said exterior surface having (a) at least one thread, (b) a plurality of sloping teeth directed radially outwardly, and (c) a retaining bead positioned axially between said threads and said teeth, a closure having (a) a top wall; (b) a side wall defining an interior surface substantially curved about an axis, an exterior surface, an upper portion, and a lower portion; (c) at least one thread on the interior surface of said side wall adapted to mate with said thread on the neck of said container; (d) a tamper-indicating band having an interior surface, an exterior surface, an upper edge, and a lower edge, the upper edge of said tamper indicating band attached to the lower portion of said closure side wall by a plurality of rupturable bridges; and said tamper-indicating band further having a plurality of sloping teeth directed radially inwardly toward the sloping teeth on the neck of the container;

wherein the providing step includes a step of ensuring that at least one tooth on the tamper indicating band engages at least one tooth on the exterior surface of the neck of the container, and that subsequent teeth on the tamper indicating band are angularly offset with respect to the teeth on the exterior surface of the neck of the container.

In use, as the closure is being removed from the container, the closure/container assembly described herein can provide the advantage of removal torques between approximately 3 and 16 inch pounds on average, thereby enabling elderly users and arthritic users to open the container with ease, without loss of back-off protection. Further, the partially engaged teeth provide a slight drag, i.e., resistance to rotation of the cap, and audible feedback to the user when the closure is rotated to open the container.

BRIEF DESCRIPTION OF THE DRAWINGS

FIG. 6 is a cross-sectional view, greatly enlarged, taken along line 6-6 of FIG. 5.

FIG. 7 is a cross-sectional view, greatly enlarged, taken along line 7-7 of FIG. 5.

DETAILED DESCRIPTION OF VARIOUS EMBODIMENTS

Figure 1:
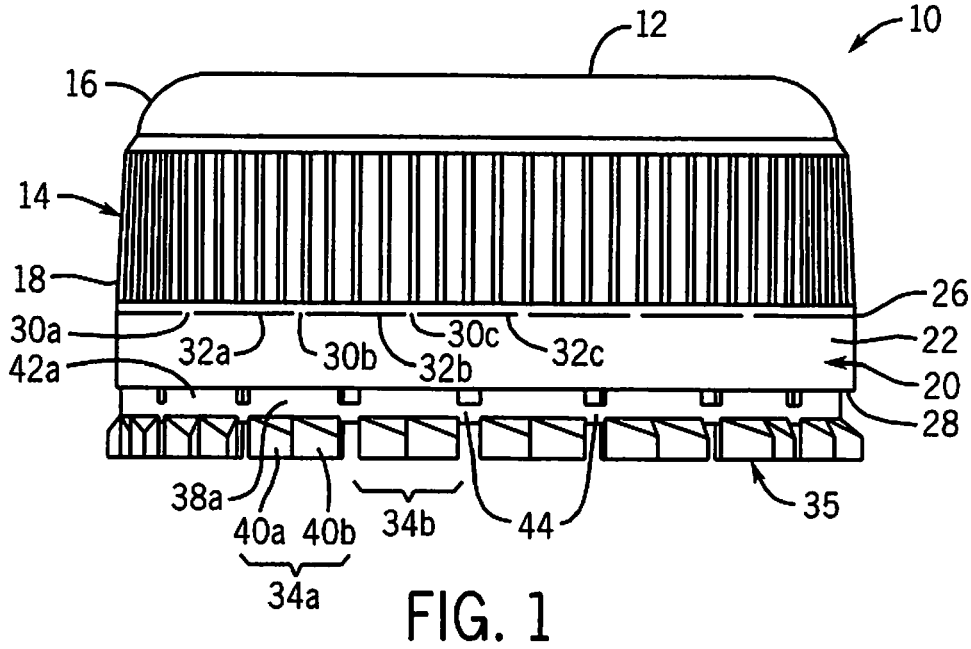
FIG. 1 is a side view in elevation of an embodiment of the closure described herein.

As used herein term "side wall" means that portion of a closure depending from the top wall of the closure. The term "side wall" is synonymous with the term "skirt." As used herein, the expression "top wall" means a panel that covers the opening of the closure that is positioned distally from the neck of the container. The expression "top wall" is synonymous with the expressions "end wall", "cover", "end panel", "upper portion". In one embodiment the closure is formed of a unitary component and the top wall is joined integrally with the side wall. In another embodiment, known as a composite closure, the top wall is distinct from the side walls, but is captured by and sealingly engages the side walls as described herein. As used herein, the expression "axis of the side wall" means a straight line about which the side wall is designed to rotate. The term "thread(s)" is intended to mean one or more screw threads.

As used herein, the term "tooth" means a projecting part resembling a tooth, as on a saw. The expressions "sloping tooth", "tooth", "ratchet" and "ratchet tooth" are equivalent, as are their plural forms (e.g. "teeth"). Analogous to a saw, each tooth includes a root (at the base arc), a face (extending generally radially outward from the base arc), a peak (at the top of the face), a gradually sloping portion from the peak back to the base arc, and generally triangular side walls.

As used herein, the expression "closure/container assembly" means a combination of the closure and the container to make a completed product. As used herein, the term "closure" means an object that closes the mouth of a container. As used herein, the term "container" means a receptacle for holding or carrying a material, the receptacle or container having walls that define a mouth or opening.

As used herein, the term "etc." is indicative of a situation in which components similar to components previously listed may be present. For example, if three like components are listed, the term "etc." indicates that there may be four or more similar components actually being referred to.

The expressions "removal force" and "removal torque" are used interchangeably and refer to the rotational force necessary to remove the closure from the container. This removal torque has two principal components: force necessary to overcome the initial sealing friction force and force necessary to break the tamper-band bridges. A third minor component is the force necessary to overcome thread friction. The sequential order of contribution of these component forces is not important.

Referring now to FIGS. 1-7, inclusive, a closure 10 comprises a top wall 12, a side wall 14, preferably cylindrical in shape, having an upper end 16 and a lower end 18. Attached to the lower end 18 is a tamper-indicating band 20, preferably cylindrical in shape, having an exterior major surface 22, preferably cylindrical in shape, an interior major surface 24, preferably cylindrical in shape, an upper edge 26, and a lower edge 28. Projecting from the upper edge 26 of the tamper-indicating band 20 is a series of rupturable or frangible bridges 30*a*, 30*b*, 30*c*, etc. These rupturable bridges 30*a*, 30*b*, 30*c*, etc., connect the tamper-indicating band 20 to the lower end 18 of the side wall 14 of the closure 10. The rupturable bridges 30*a*, 30*b*, 30*c*, etc., must be broken or ruptured to cause the tamper-indicating band 20 to separate from the side wall 14 to provide an indication of the opening of the container. Rupturable bridges 30*a*, 30*b*, 30*c*, etc., are described, for example, in U.S. Pat. No. 4,981,230, incorporated herein by reference. Between the rupturable bridges 30*a*, 30*b*, 30*c*, etc., are openings 32*a*, 32*b*, 32*c*, etc. The purpose of the rupturable bridges 30*a*, 30*b*, 30*c*, etc., is to attach the tamper-indicating band 20 to the lower end 18 of the side wall 14. The purpose of the openings 32*a*, 32*b*, 32*c*, etc., is to provide sufficient separation between the rupturable bridges 30*a*, 30*b*, 30*c*, etc., to enable the rupturable bridges 30*a*, 30*b*, 30*c*, etc., to be broken by a removal torque that can be generated by an elderly or arthritic user. The number of rupturable bridges 30*a*, 30*b*, 30*c*, etc., formed around the circumference of the closure typically ranges from about five (5) to about fifteen (15). If the rupturable bridges 30*a*, 30*b*, 30*c*, etc., are too narrow, they will be broken during production. If the rupturable bridges 30*a*, 30*b*, 30*c*, etc., are too wide, the closure cannot be removed from the neck of the container without application of a significant amount of torque. For example, the rupturable bridges can range from about 0.003 inch to about 0.050 inch in width, assuming they are the full thickness of the wall in which they are formed. Of course, one skilled in the art will realize that the cross-sectional area is what contributes the bridge strength, so wider bridges may be employed if they are not the full thickness of the wall. Scoring the wall can produce rupturable bridges of this type.

Projecting from the lower edge 28 of the tamper-indicating band 20 is a series of tabs 34*a*, 34*b*, 34*c*, etc. These tabs 34*a*, 34*b*, 34*c*, etc. are substantially rectangular in shape. For the sake of simplification, tab 34*a* will be described in detail. However, it should be noted that tabs 34*b*, 34*c*, etc., are substantially identical to tab 34*a*. Tab 34*a* has an interior major surface 36*a* and an exterior major surface 38*a*. On the exterior major surface 38*a* of tab 34*a* is formed at least one sloping tooth 40*a*. Typically, the aforementioned exterior major surface 38*a* of tab 34*a* contains two or more sloping teeth 40*a* and 40*b*. Tab 34*a* is attached to the lower edge 28 of the tamper-indicating band 20 by a living hinge 42*a*. The living hinge 42*a* is designed so as to enable the tab 34*a* to be folded, whereby the interior major surface 36*a* of the tab 34*a*, i.e., the major surface not bearing the teeth 40*a* and 40*b*, is generally flush against the interior major surface 24 of the tamper-indicating band 20, and the exterior major surface 38*a* of the tab 34*a*, i.e., the major surface bearing the sloping teeth 40*a* and 40*b* faces away from the tamper-indicating band 20 and radially inward toward the axis of the side wall 14. As best shown in FIG. 7, the hinge 42*a* may allow some spring in the folded tab 34*a* that supplies a gentle pressure radially inwardly on the teeth 40*a*, which helps keep them engaged with teeth 116*a* on the container. The downward-facing end of each tab 34*a*, 34*b*, etc., that is distal, i.e. not attached to the tamper band 20 via the living hinge 42, forms a surface 35, the function of which is described later.

Between each set of adjacent tabs, e.g., 34*a* and 34*b*, or 34*b* and 34*c*, etc., is connecting bridge or connector 44. The purpose of the connector 44 is to enable all of the tabs 34*a*, 34*b*, 34*c*, etc., to be simultaneously folded up so as to contact the interior major surface 24 of the tamper-indicating band 20. In addition, the connectors 44 maintain proper alignment between adjacent tabs 34*a*, 34*b*, 34*c*, etc., so that consistent performance and consistent opening force is provided during the operation of removing the closure 10 from the neck of the container. There is a gap between each connector 44 and the lower edge 28 of the tamper-indicating band 20 to enable to living hinges 42*a* to function with a low level of resistance to folding. In one variation (not shown) the connector 44 may exist near the distal ends of tab 34*a* and 34*b*, etc., whereby it can contribute to the surface 35 and optionally forms a continuous annular surface 35 that is a ring (not shown) in the closure 10 for purposes that will be described later. The width of the connectors 44 should be sufficiently low in order to reduce the force required to open the container. For example, the width of the connector 44 can be as low as 0.003 inch. However, the width of the connectors 44 must be sufficient in order to maintain adequate strength during the operations of filling the container and applying the closure 10 to the container. For example, the width of the connector 44 can be as high as 0.10 inch, and, as with the rupturable bridges, its strength depends on its width and thickness. Tabs 34*a*, 34*b*, 34*c*, etc., and connectors 44 are described, for example, in U.S. Pat. No. 4,981,230, previously incorporated herein by reference.

Figure 2:
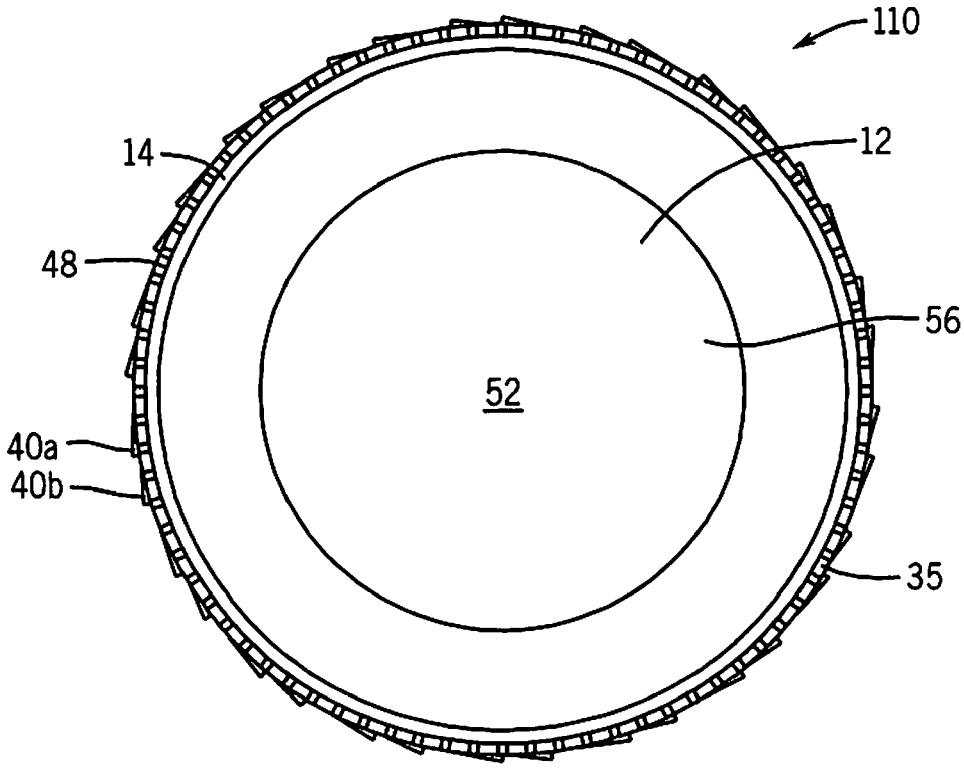
FIG. 2 is a top plan view of the closure of FIG. 1. In this figure, the tabs are not folded so as to be encircled by the tamper-indicating band.
Figure 3A:
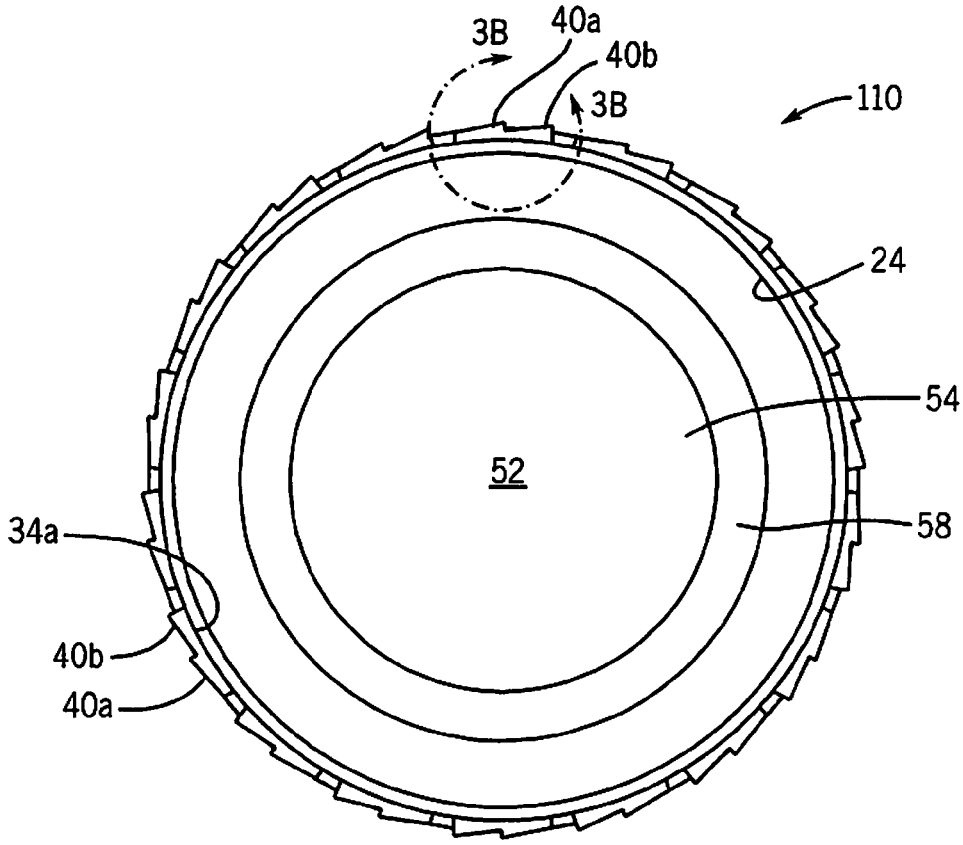
FIG. 3A is a bottom plan view of the closure of FIG. 1. In this figure, the tabs are not folded so as to be encircled by the tamper-indicating band.
Figure 3B:
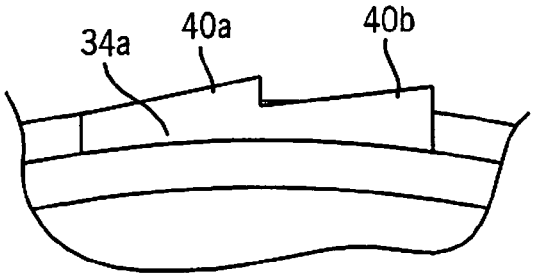
FIG. 3B is an enlarged view of area 3B of FIG. 3A. In this figure, the tabs are not folded so as to be encircled by the tamper-indicating band.
Figure 3C:
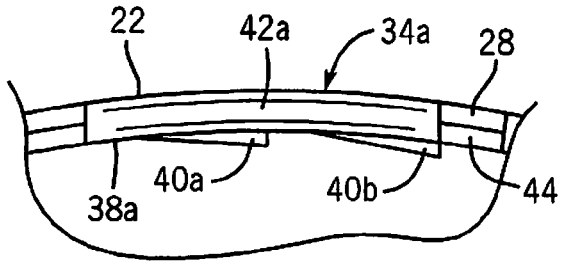
FIG. 3C is an enlarged view of area 3B of FIG. 3A. In this figure, the tabs are folded so as to be encircled by the tamper-indicating band.

In a first closure embodiment, the closure 110 is composite and is formed of two discreet parts: an annular side wall and a disk-like top wall that is captured within the side wall. As best shown in FIGS. 2, 3 and 7, the side wall 14 has an interior major surface 46 and an exterior major surface 48. In the interior major surface 46 of the side wall 14 positioned near the upper end 16 of the side wall 14 is a groove 15, defined by an annular ridge 17 as a lower boundary and a curved upper wall portion 16. This groove 15 receives a disk 52 having an interior major surface 54 and an exterior major surface 56, which disk 52 forms the top of the closure 110. The groove 15 is sufficiently wide so that the disk 52 can be rotated therein. This permits initial rotation of the closure without needing to overcome the resistance forces associated with unsealing the container. For reasons described in prior patents, e.g. U.S. Pat. No. 4,813,561, the disk 52 may optionally contain an annular downward facing U-shaped lip as shown in FIG. 7, which fits into the groove 15. At the peripheral edge of the inner major surface 54 of the disk is a layer 58 of oxygen-impervious, moisture-impervious polymeric sealant material, which functions as a gasket or seal.

Figure 9:
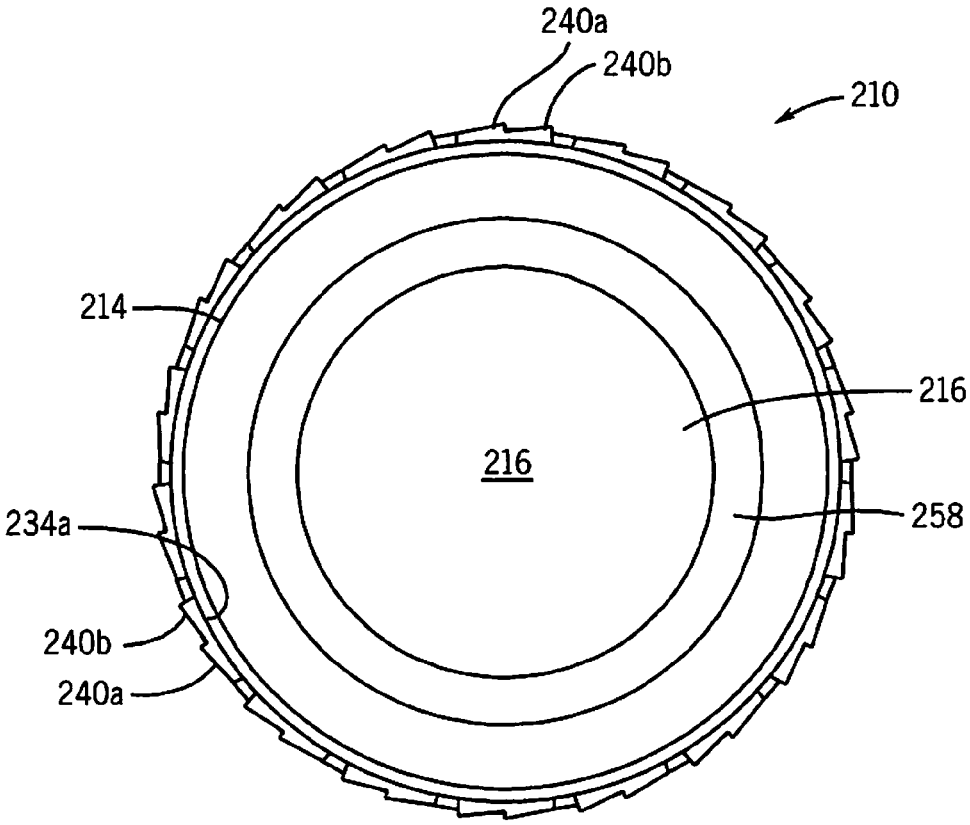
FIG. 9 is a bottom plan view similar to FIG. 3A, but of an alternative embodiment of the closure of the invention, showing a one-part or integral closure.

In a second closure embodiment, shown in FIG. 9, the side wall 214 and top wall 216 of the closure 210 are integrally formed as one piece. Side wall 214 contains downwardly depending tabs 234 that contain sloping teeth 240*a*, 240*b*, etc., just as in the two-part embodiment. The structure and function of the one part closure is similar in many respects to the two part closure: including the teeth interaction with the container, the tamper band, hinges and bridges, so these details are not repeated here. What differs with the one-part closure 210 is the sealing surface 258 and the rotational force analysis. With a one part closure 210 the initial removal torque must overcome the sealing friction force. For this reason, it is desirable to use sealant polymers on the sealing surface 258 that can provide good sealing properties and yet maintain minimal friction forces upon twisting. Selected polymers that can achieve this are described below.

In either embodiment, the interior major surface 46 of the side wall 14 contains thread(s) 60, which mate with thread(s) 108 on the neck of the container, which will be described in detail later.

Figure 8:
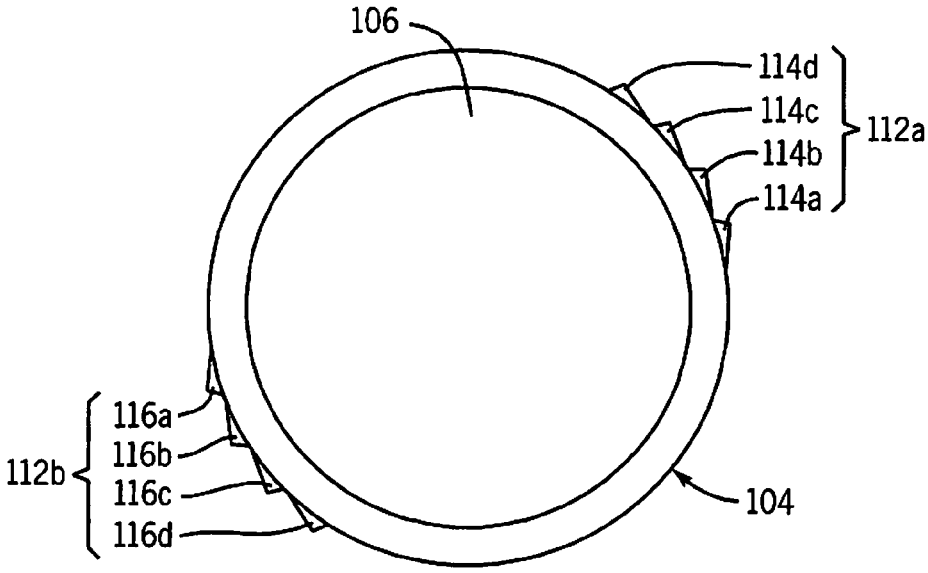
FIG. 8 is a top plan view of the neck of the container shown in FIG. 4.

Referring now to FIGS. 4-8, inclusive, a container 100 suitable for use with the closure 10 or the closure 210 described herein typically comprises a body 102 having walls defining a neck 104. The neck 104 of the container 100 surrounds the mouth 106 of the container 100. The neck 104 of the container 100 comprises thread(s) 108, which mate with the thread(s) 60 on the interior major surface 46 of the side wall 14 of the closure 10, 210. The start of the thread(s) 108 is designated by the reference numeral 109. Also on the neck 104 of the container 100 are a set 112*a* of sloping teeth 114*a*, 114*b*, 114*c*, 114*d* and a set 112*b* of sloping teeth 116*a*, 116*b*, 116*c*, 116*d*. In FIG. 8, two sets 112*a*, 112*b* of sloping teeth are shown; however, more sets of sloping teeth, each set separated from the other by a gap, or even a continuous ring of teeth (not shown) can be formed on the neck 104 of the container 100. Sloping teeth 114*a*, 114*b*, 114*c*, 116*a*, 116*b*, 116*c*, 40*a*, 40*b* are described, for example, in U.S. Pat. No. 4,813,561, incorporated herein by reference.

The teeth are designed opposingly, such that the tooth face of teeth on one component (e.g. the container) provides a catching surface for engaging the tooth face or ratchet on an opposing component (e.g the closure tamper band). However, neither the directionality nor the ordering of the teeth is otherwise critical. It is also noted that one side wall of the teeth can also form a surface 35, shown as a discontinuous surface in FIGS. 1 and 2

Figure 4:
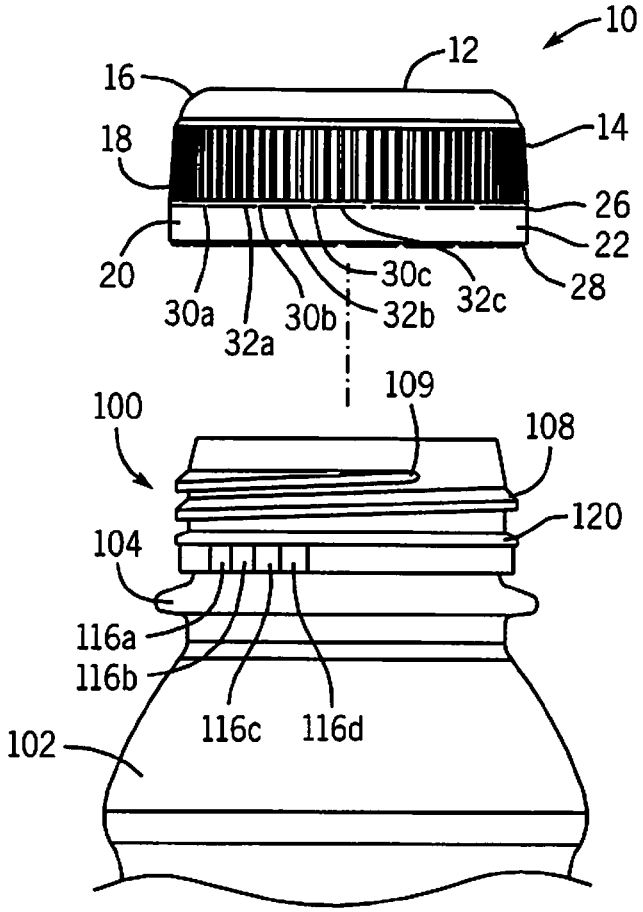
FIG. 4 is an exploded side view in elevation of the closure of FIG. 1 and a container that receives the closure.
Figure 5:
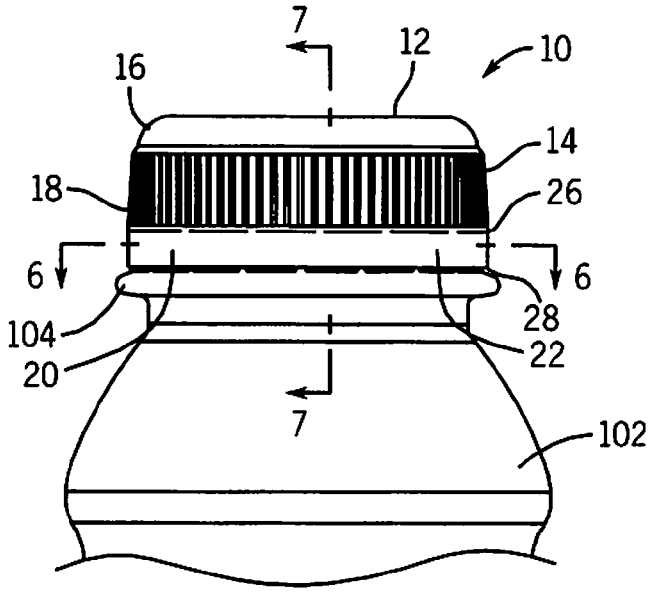
FIG. 5 is a side view in elevation of the assembly of the closure and the container of FIG. 4.

As best seen in FIGS. 4 and 7, the neck 104 of the container 100 further comprises an annular retaining ledge or bead 120. The retaining bead 120 has a downward facing lower surface 122 that is positioned to engage the surface 35 of the tabs 34, once they have been folded back into position inside the closure. This lower surface 122, unlike the threads 108, is in a plane that is approximately perpendicular to the axis of the container neck. The interference fit of the lower surface 122 of annular bead 120 against the distal surface 35 of the folded tabs 34 (see FIG. 7) prevents removal of the tamper-indicating band 20 when the closure 10 is removed from the neck 104 of the container. As is described later in connection with operation, this interference fit is also the mechanism for breaking the rupturable bridges 30*a*, 30*b*, etc., upon removal of the closure 10. In the embodiment shown, the retaining bead 120 completely encircles the neck 104 of container 100, however this is not an essential feature. In the embodiment shown, the retaining bead 120 is annular, extending continuously around the circumference of the neck, however, it may well be intermittent and discontinuous around the periphery, provided at least one of the lower surface 122 of the bead 120 or the distal surface 35 of the tabs 34*a*, 34*b*, etc., is substantially continuous and annular.

Although the sloping teeth 114*a*, 114*b*, 114*c*, 114*d* and the sloping teeth 116*a*, 116*b*, 116*c*, and 116*d* (and optionally other sets of sloping teeth similar to 114*a*, 114*b*, 114*c*, 114*d*, 116*a*, 116*b*, 116*c*, and 116*d* on the neck 104 of the container 100) engage the sloping teeth 40*a* and 40*b* (and optionally other sets of sloping teeth similar to 40*a* and 40*b* on the closure 10), the sloping teeth on the neck 104 of the container 100 are angularly offset slightly from the sloping teeth on the tabs 34*a*, 34*b*, 34*c*, etc. This is best shown in FIG. 6, where the closure teeth 40*a*, 40*b*, on each tab 34*a*, 34*b*, etc., are staggered or offset from the teeth 116*a*, 116*b*, 116*c*, etc., of the container 100. If each the sloping teeth 116*a*, 116*b*, 116*c*, and 116*d* (and optionally also teeth 114*a*, 114*b*, 114*c*, and 114*d*) are positioned so that a given tooth arc (i.e. the arc distance from one tooth peak to the next tooth peak) occupies θ° of the circumferential arc of the neck 104 of the container 100, then the sloping teeth 40*a* and 40*b* on the tab 34*a* are positioned with a different angular interval such that the tooth arc of a given tooth 40*a* does not occupy θ° or an integral multiple of θ° of the circumferential arc formed by the tabs 34*a*, 34*b*, 34*c*, etc., of the closure 10. In an exemplary embodiment, if each of the sloping teeth 114*a*, 114*b*, 114*c*, and 114*d* and each of the sloping teeth 116*a*, 116*b*, 116*c*, and 116*d* are positioned so that a given tooth arc occupies 10° of the circumferential arc of the neck 104 of the container 100, then a given tooth arc 40*a*, 40*b* on a tab 34 can occupy, for example, 12.5° of the circumferential arc formed by the tabs 34*a*, 34*b*, 34*c*, etc., of the closure 10, creating an angular delta or offset of 2.5° in the angular spacing of the two sets of teeth.

The angular spacing is not limited to 10° for sloping teeth 114*a*, 114*b*, 114*c*, and 114*d* and sloping teeth 116*a*, 116*b*, 116*c*, and 116*d* on the neck 104 of the container 100. This angular spacing simply permits 36 teeth circumferentially around the container 100. Greater or fewer teeth may be spaced about the circumference according to the known formula: No. of teeth desired/360 gives the angular spacing (for continuous teeth). Nor is the offset delta limited to 2.5° for sloping teeth 40*a*, 40*b* on the circumference formed by the tabs 34*a*, 34*b*, 34*c*, etc., of the closure 10. These are simply examples. The offset for the closure teeth 40*a*, 40*b*, can be, for example, any angle or fractional angle that is not an integer multiple of the angular spacing of the container teeth (e.g. 116*a*, 116, b, etc.). Typical offset deltas may be, for example, between 0.1° and 10°, more commonly between 1° and 5°. However, as noted, if the teeth on container occupy θ° of the circumferential arc, then the offset delta cannot be nθ°, where n is an integer, or else the desired staggering of the teeth is defeated. Offsetting the sloping teeth 40*a* and 40*b* on the tabs 34*a*, 34*b*, 34*c*, etc., of the closure 10 from the sloping teeth 114*a*, 114*b*, 114*c*, and 114*d* and sloping teeth 116*a*, 116*b*, 116*c*, and 116*d* on the neck 104 of the of the container 100 provides at least two advantages:

(a) lower removal torque (b) greater strength to with stand the backoff forces encountered during production and distribution It should also be noted that any two adjacent sloping teeth, e.g., 114*a*, 114*b*, on the neck 104 of the container 100 or any two adjacent sloping teeth, e.g., 40*a* and 40*b*, on a tab 34*a* need not abut one another. Adjacent sloping teeth e.g., 114*a*, 114*b*, on the neck 104 of the container 100 or adjacent sloping teeth on a tab 34*a* can be separated by a small angular distance, such as, for example 1° of arc. However, the requirement specified previously for the offset must be adhered to in order to obtain the benefits of the closure described herein.

L=length of arc on the circumference of the closure in degrees and length of arc on the circumference of the neck 104 of the container 100 in degrees $n_{tc}$=number of teeth in the at least one set of sloping teeth in the arc L on the closure 10

$n_{tb}$=number of teeth in the at least one set of sloping teeth in the arc L on the container 100

In order to ensure that the at least one set of teeth on the closure only partially engages the at least one set of teeth on the neck 104 of the container 100, it is preferred that $n_{tc}$ not be equal to equal to $n_{tb}$ and that $L/n_{tc}$ not be equal to $L/n_{tb}$ As a representative example, if L=50°, then $n_{tc}$=5 and $n_{tb}$=4. As can be seen in FIG. 6, the arc L contains five teeth 40*a*, 40*b*, 40*a*, 40*b*, and 40*a* of the closure and four teeth 116*a*, 116*b*, 116*c*, and 116*d* of the container 100.

If reducing removal torque were the sole consideration, it would be preferred that all of the teeth in all of the sets of teeth on the neck 104 of the container 100 be offset from the teeth of the closure 10 with which they are partially engaged, or even that no teeth at all existed. However, without at least partial engagement of some teeth in of the container 100 with teeth of the closure 10, the risk of "back off" increases unacceptably. The present invention is a unique compromise between these conflicting concerns. Accordingly, it is preferred that at least one, but not all, of the teeth in each set of teeth on the neck 104 of the container 100 be completely engaged with a tooth on the closure 10, so that removal torque is reduced from the situation in which all of the teeth in each set of teeth on the neck 104 of the container 100 are engaged, while "anti-back off" features are still retained. For example, if the neck 104 of the container 100 contains two sets of teeth positioned 180° apart and each set of teeth contains four teeth (as depicted in FIG. 8), it is preferred that at least one of the four teeth in each set of teeth be completely engaged with a tooth on the closure 10 and that the remaining teeth be not engaged or only partially engaged with the teeth on the closure 10. While two sets of teeth are depicted in the embodiment of FIG. 8, it will be understood that from one set to about 12 sets may be used about the circumference of the neck, depending on the sizes and number of teeth per set. Indeed a continuous row of teeth is possible as well, although 2-6 sets seem preferable.

Referring to FIG. 6, it can be seen that tooth 40*a* of the closure tamper band 20 is completely engaged with tooth 116*a* of the container. During the undesirable backoff process, this tooth may become disengaged, allowing the closure and tamper band 20 to slip counterclockwise past this point until a subsequent tooth engages. By staggering the teeth as described above, the next most likely teeth to become engaged will be closure tooth 40*a* that is already nearly engaged with container tooth 116*d* in the figure, rather than the next adjacent closure tooth, 40*b*, engaging with container tooth 116*a*. This minimization of backoff rotation tends to preserve the necessary sealing of the container, while providing easier removal torque. Optionally, two or more teeth of each set of four teeth on the neck 104 of the container 100 can be completely engaged with teeth on the closure 10, however, it should be noted that as more teeth of each set of teeth on the neck 104 of the container 100 are engaged with teeth of the closure 10, the amount of force required to remove the closure 10 increases.

The material of the closure 10 can be any polymeric material capable of being molded, cut, folded, and assembled to form the closure 10 described herein. Representative examples of polymeric material suitable for preparing the closure 10 include, but are not limited to, polyolefins, such as, for example, polypropylene and polyethylene. Other polymeric materials, such as, for example, polycarbonate, polyvinyl chloride, polystyrene, polylactic acid, synthetic elastomers, natural latex rubbers, polyesters, such as, for example, polyethylene terephthalate, nylon, and similar materials.

Materials that are suitable for preparing the disk 52 that is inserted in the groove 15 in the two part closure 110 are capable of being formed, stamped, cast, or molded into shapes having specified surface dimensions and width dimensions and that exhibit specified flexibility or rigidity. Representative examples of materials suitable for preparing the disk 52 include, but are not limited to, metals, composite materials comprising metal, other composite materials not comprising metal, or polymeric materials comprising a single layer or a plurality of layers laminated together. Representative examples of metals suitable for preparing the disk 52 include, but are not limited to, stainless steel, tin-free steel, aluminum, metal composites containing carbon, and other composite materials. Representative examples of polymeric materials suitable for preparing the disk 52 include, but are not limited to, polyolefins, such as, for example, polypropylene and polyethylene. Other polymeric materials, such as, for example, polycarbonate, polyvinyl chloride, polystyrene, polylactic acid, synthetic elastomers, natural latex rubbers, polyesters, such as, for example, polyethylene terephthalate, nylon, and similar materials.

Properties of metal disks that can be used in the closure of this invention are described, for example, in U.S. Pat. No. 4,991,731, incorporated herein by reference. See column 4, line 53 through column 5, line 24 of U.S. Pat. No. 4,991,731. The disk described in U.S. Pat. No. 4,991,731 further contains a fusible coating on the major surface thereof facing the contents of the container 100. Disks suitable for use herein can also have such a fusible coating on the major surface thereof facing the contents of the container 100 or on both major surfaces thereof. Such fusible coatings for metallic disks include, but are not limited to, epoxy coatings, enamel coatings. Another coating material suitable for composite disks or polymeric disks is ethylene vinyl acetate. It is not required that the disk have a fusible coating on one or both major surfaces thereof.

The gasket 58 that is placed around the peripheral edge of the disk is a polymeric material that is capable of creating a hermetic seal by means of terminal sterilization at a temperature of up to 275° F. Representative examples of polymeric materials suitable for preparing the gasket 58 include, but are not limited to, polymeric materials comprising a single layer or a plurality of layers laminated together, which materials can be formed, stamped, cast, or molded into shapes having specified surface dimensions and thickness dimensions. Representative materials suitable for preparing the gasket 58 include, but are not limited to, polyolefins, such as, for example, polypropylene and polyethylene, polystyrene, polylactic acid, synthetic elastomers, natural latex rubbers, polyesters, such as, for example, polyethylene terephthalate, nylons and other soft to rigid materials modified for a specified value of durometer. U.S. Pat. No. 4,981,230, previously incorporated herein by reference, discloses plastisols for preparing the gasket 58. A typical plastisol is a polyvinyl chloride resin that is applied from a solvent.

The choice of material for gasket 58, 258 may depend on the type of closure: one part or two. For reasons related to the operation of the assembly, gasket 58 in the two-part closure 110 may be a softer, more deformable material to create an effective seal. Friction is not a major concern since the disk 52 is lifted from the container. However, in the one part closure 210, the rotational torque must unseat the gasket 258 and break the seal. To overcome this additional friction component of the torque, gaskets and polymers that reduce friction are preferred in the one part closure 210. Plastic polymers and/or gaskets that are modified with the addition of slipping agents. Slipping agents that are suitable for this friction-reducing purpose include waxes, such as Euricimide®, and polyfluorinated polymers, such as Teflon® brand PTFE and related co-polymers. Alternatively, the container may be hermetically sealed by a foil layer, and slipping agents may be used with the foil and the plastic polymers of the closure to reduce the friction. In another alternative, reducing the area of the contact surfaces, for example, by making the sealing surface of the neck very thin can reduce friction. This alternative introduces a tradeoff with ensuring a hermetic seal however.

The container 100 is preferably made of a polymeric material that is a single layer material or a multiple layer material that can be formed, stamped, cast, or molded into a shape having specified dimensions and specified wall thicknesses. The polymeric material can be either flexible or rigid. Representative example of polymeric material suitable for preparing the container 100 include, but are not limited to, polyolefins, such as, for example, polypropylene and polyethylene, which polyolefins can optionally be blended with ethyl vinyl alcohol, ethylene vinyl acetate, polyvinylidene chloride (saran), Surlyn® resin, Admer® resin, or similar barrier and adhesive layers. Other polymeric materials, such as, for example, polycarbonate, polyvinyl chloride, polystyrene, polylactic acid, synthetic elastomers, natural latex rubbers, polyesters, such as, for example, polyethylene terephthalate, nylon, and similar materials can also be used.

In place of a series of rupturable bridges 30*a*, 30*b*, etc., between the tamper-indicating band and the lower portion of the side wall, a line of weakness can be formed between the tamper-indicating band and the lower portion of the side wall. Upon removal of the closure from the container 100, the tamper-indicating band will separate from the lower portion of the side wall along the line of weakness. The line of weakness and method for forming a line of weakness is described in U.S. Pat. No. 4,813,561, incorporated herein by reference.

A tamper-indicating band 20 can be provided to the lower end 18 of the side wall 14 by means of a mold that has been designed for that purpose. Then, an appropriate blade can be used to form the openings 32*a*, 32*b*, 32*c*, etc., adjacent to the rupturable bridges 30*a*, 30*b*, 30*c*, etc. The blade can be a component of the mold or can be provided separately from the mold. In lieu of the use of rupturable bridges 30*a*, 30*b*, 30*c*, etc., it is suitable, but not preferred, to employ a score line (not shown) to form a weakened region between the tamper-indicating band 20 and the lower end 18 of the side wall 14.

Containers and methods for making thereof are described in U.S. Pat. Nos. 4,349,116; 4,991,731; 5,004,110; and 5,217,737, all of which are incorporated herein by reference.

Conventional closure application machinery can be used to apply the closure 10 to the container 100. Specifically, capping machinery would have grasping elements commonly known as capping chucks to grasp and hold the closure 10 in a position above the neck 104 of the container 100 for placement of the closure 10 onto the neck 104 of the container 100. Prior to applying the closure 10 to the container 100, the tabs 343*a*, 34*b*, and 34*c*, etc., are folded so that the teeth 40*a*, 40*b*, face radially inward toward the axis of the side wall 14. The capping chucks are driven by a suitable source of energy, and suitable mechanical linkages are utilized to spin the chuck at the appropriate speed to apply the closure 10 to the neck 104 of the container 100. The capping chuck must also have the means for limiting the rotational force and terminating the capping operation once the closure 10 has sealed the container 100 but not advanced so far as to rotate beyond the available thread(s) 108 on the neck 104 of the container 100 or the available thread(s) 60 on the interior major surface 46 of the side wall 14 of the closure 10.

Operation

To open the container 100 described herein, an individual grasps the closure 10 and twists so as to apply sufficient removal torque to the closure 10. On account of the offset of all but at least one of the sloping teeth in the sets of sloping teeth on the neck 104 of the container 100 relative to the sloping teeth on the closure 10, the removal torque can be as low as 3 inch pounds on average, and is typically less than 18 inch pounds on average, more likely less than 16 inch pounds on average. This low level of removal torque renders the assembly of the closure and the container 100 described herein suitable for use by arthritic users and elderly users. An unbroken tamper-indicating band 20 assures the user that the assembly of the closure 10 and the container 100 has not been subject to tampering. As the closure is twisted off, the torque must overcome both the sealing friction, which is higher in the one-part cap embodiment, the tamper band force and the thread friction force.

As removal torque is applied to the closure 10, the closure 10 rides upward on the threads on the neck 104 of the container 100 pulling the attached tamper band 20 in an upward axial direction. However, the retaining band 120 catches the sloping teeth 40*a*, 40*b*, etc., which resists the upward pulling on the tamper band 20, thereby causing an axial stretching force on the rupturable bridges 30*a*, 30*b*, etc. As the closure 10 continues to ride up the thread, this axial stretching force eventually causes tearing or breaking at the rupturable bridge in the vicinity of greatest stretch. As the closure continues upward on the threads, additional rupturable bridges are broken, but in a sequential or serial manner, thus reducing the torque necessary to remove the closure. Once the last rupturable bridge is broken, the tamper-indicating band 20 separates from the lower end 18 of the side wall 14 of the closure 10. The retaining bead 120 enables the container 100 to retain the tamper-indicating band 20 on the neck 104 of the container 100.

The threads on the container 100 and the threads on the closure 10 can have the shape shown in FIGS. 4 and 7, in which the bottom surface of the thread(s) 108 of the neck 104 of the container 100 and the top surface the thread(s) 60 of the closure 10 are made relatively flat and, in a radial dimension, horizontal. (They of course have a pitch in a circumferential direction.) The result is that any relative movement between the thread(s) 60 and the thread(s) 108 during a retorting operation caused by the unequal expansion of the closure 10 and the container 100 causes an insignificant relative vertical movement between the thread(s) 60 and the thread(s) 108 so that the threads retain their vertical tension for both heated and cooled packages. Threads for closures and containers are described in further detail in U.S. Pat. No. 4,813,561, incorporated herein by reference.

For the embodiment of the two-part closure 110 shown in FIGS. 2, 3 and 7, a further advantage is obtained, whereby the torque necessary to stretch and break the rupturable bridges 30*a*, 30*b*, etc., is at least partially distinct from the torque necessary to overcome the friction of the seal. In this embodiment, the disk 52 can remain seated on the mouth 106 of the neck 104 of the container 100 until it is lifted from the mouth 106 by the annular ridge 17 on the interior surface 46 of the closure side wall 114. If the depth of the groove 15 is sufficient, a significant portion of the rupturable bridges 30*a*, 30*b*, etc., may be broken before the annular lip 17 engages disk 52 and the friction of the seal adds a component of torque to lift the disk 52 off the mouth 106 of the container 100.

Operation as described above as an opening process and that is consistent with the main problem being addressed, which is the balancing of tradeoffs between sufficient backoff protection while maintaining an opening torque that is acceptable to persons who have difficulty opening containers, such as persons who are elderly or afflicted with arthritis. However, it is also to be appreciated that that closure must be installed on the container in the first place, substantially without breaking the very same rupturable bridges of the tamper indicating band. Although some rupturable bridges may be broken, it is a matter of process control to minimize the installation breakage to a acceptable levels, so allow the tamper resistance feature to be realized. This can be achieved by one or more of several mechanisms.

In a first mechanism, the tolerances of the container and the closure are tightly matched so that the closure 10 fits over the retaining bead 120 just barely, and subsequent deformations of the tamper indicating band 20 allow it to catch on the retaining bead 120. A second mechanism, best shown in FIG. 7, provided a slight springiness in the living hinge 42*a*, which allows the folded tabs 34*a*, 34*b*, etc., to be pushed against interior surface 36*a* of the tamper indicating band 20, allowing the associated teeth 40*a*, 40*b*, etc to deflect radially outwardly over the retaining bead 120 as the closure 10 is forced down onto the container 100, but still allows the teeth 40*a*, 40*b*, etc., to spring back radially inwardly to catch the under surface 122 of the retaining bead 120 when the closure is removed. Finally, the closure and/or container may be heated to soften the plastic polymers to allow for expansion and deformation and spring of all the components. It may be preferable to use all these techniques to install closures on the containers in the first place with and acceptable number of rupturable bridges still intact.

Example 1

The removal torque was measured for closure assemblies made according to the invention and compared with removal torques of prior art closure assemblies. The removal torque for prior art closure assemblies had a typical removal torque of about 17-18 inch pounds, whereas the removal torque for closure assemblies according to the invention had a typical removal torque of about 9-10 inch pounds.

Example 2

Closure assemblies like those of example 1 and a third closure assembly having a removal torque of about 23 were tested in interviews with 164 actual users. The users were grouped into three categories: mothers of young children (N=54), arthritics (N=75) and independent-living seniors (N=35). Each user was asked to open each of the three container-closure assemblies in a balanced complete block statistical design (to eliminate sequence bias), and users were asked to rank the assemblies on two parameters: Difficulty of opening was ranked on a scale of 1 to 9 (1=not at all difficult, 9=extremely difficult); and overall "Acceptability" was ranked from 1 to 9 (1 to 5.0 deemed acceptable; 5.1 to 9 deemed unacceptable).

Mean data is presented in the table below.

| | Removal Torque = 23 | Removal Torque = 18 | Closure of Invention (Torque = 10) |
|---|---|---|---|
| Difficulty of Opening | | | |
| Seniors (N = 35) | 4.9 | 5.4 | 1.8 |
| Arthritics (N = 75) | 4.6 | 4.9 | 2.2 |
| Mothers (N = 54) | N/A | 3.3 | 2.4 |
| Acceptabilty | | | |
| Seniors (N = 35) | 4.9a | 5.4a | 1.8b* |
| Arthritics (N = 75) | 4.6a | 4.9a | 2.2b* |
| Mothers (N = 54) | N/A | 3.3b* | 2.4a* |

Scores designated with different letters are statistically different.
Scores designated with a * are statistically below the top of the acceptability range.

It can be seen from the data that the closure assembly of the invention was judged far easier to open, especially for the seniors and arthritics. Overall acceptability was also significantly higher with the closure assembly of the invention.

This invention allows the removal torque of a closure to be controlled at a low level, such as, for example less than 16 inch pounds on average. The invention also allows an audible feature as the closure is being rotated. This closure is particularly useful for both elderly and arthritic patients.

The closure/container assembly described herein can be utilized in any closure/container assembly intended to be used by either elderly or arthritic patients.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An assembly comprising a container and a closure, said container having a neck, said neck having an interior surface, an exterior surface substantially curved about an axis, said interior and exterior surfaces joining at an opening of said neck, said exterior surface having (a) at least one thread, (b) a plurality of sloping teeth directed radially outwardly, and (c) a retaining bead positioned axially between said threads and said teeth, wherein each of the sloping teeth has an engagement surface;

said closure having (a) a top wall; (b) a side wall defining an interior surface substantially curved about an axis, an exterior surface, an upper portion, and a lower portion; (c) at least one thread on the interior surface of said side wall adapted to mate with said thread on the neck of said container; (d) a tamper-indicating band having an interior surface, an exterior surface, an upper edge, and a lower edge, the upper edge of said tamper indicating band attached to the lower portion of said closure side wall by a plurality of rupturable bridges; and said tamper-indicating band further having a plurality of sloping teeth directed radially inwardly toward the sloping teeth on the neck of the container, each of the sloping teeth of the tamper-indicating band having an engagement surface that is engageable with one of the engagement surfaces of the sloping teeth of the container;

wherein the sloping teeth on the tamper-indicating band are configured such that when the engagement surface of one of the teeth on the tamper-indicating band completely engages the engagement surface of one of the teeth on the exterior surface of the neck of the container, the engagement surface of at least one of the other sloping teeth on the tamper-indicating band is free from engagement with the engagement surfaces of the sloping teeth of the container, and the engagement surface of at least one of the other sloping teeth of the container is free from engagement with the engagement surfaces of the sloping teeth on the tamper-indicating band.

2. The assembly of claim 1, wherein the sloping teeth on the tamper-indicating band are formed on a radially outwardly facing exterior surface of a plurality of tabs depending downwardly from the lower edge of the tamper-indicating band, said tabs being connected to said lower edge by a hinge such that the sloping teeth on the outwardly facing exterior surface of the tabs are folded into a radially inwardly facing position.

3. The assembly of claim 2, further including a connector that extends between and connects at least two adjacent tabs of the plurality of tabs.

4. The assembly of claim 3, wherein a connector extends between each adjacent downwardly depending tab of the plurality of tabs at a lowermost portion of said tabs, such that, when folded inwardly, said connector together with an upwardly facing side wall of the inwardly facing sloping teeth on the tab form a continuous surface that abuts and produces an interference fit against said retaining bead, thereby retaining the tamper-indicating band around the neck of the container upon removing said closure from the container.

5. The assembly of claim 1, wherein said retaining band on the container forms a complete annular surface that abuts and produces an interference fit against an upwardly facing side wall of the inwardly facing sloping teeth, thereby retaining the tamper-indicating band around the neck of the container upon removing said closure from the container.

6. The assembly of claim 1, wherein said at least one thread is inclined sufficiently to enable rotation of the closure to bring about serial rupture of the rupturable bridges of the closure.

7. The assembly of claim 1, wherein the sloping teeth of the container includes two or more sets of sloping teeth separated by gaps.

8. The assembly of claim 1, wherein each set of sloping teeth comprises at least two of the sloping teeth.

9. The assembly of claim 2, wherein each tab contains at least two of the sloping teeth.

10. The assembly of claim 2, wherein each downwardly depending tab on the closure includes a plurality of the sloping teeth on the exterior surface thereof.

11. The assembly of claim 1, wherein said closure comprises a distinct side wall and top wall, and wherein the side wall comprises a groove formed in the interior surface of said side wall for receiving a top wall comprising a disk for sealing said opening.

12. The assembly of claim 11, wherein said disk fits loosely in said groove such that initial torque or backoff can occur without breaking the seal formed by the disk and the opening of the neck.

13. The assembly of claim 1, wherein the teeth on the tamper-indicating band are configured such that when the engagement surface of one of the teeth on the tamper-indicating band completely engages the engagement surface of one of the teeth on the exterior surface of the neck of the container, the engagement surface of at least one of the other teeth on the tamper-indicating band is free from engagement with the engagement surfaces of the teeth of the container and the engagement surface of every one of the other teeth of the container is free from engagement with the engagement surfaces of the teeth on the tamper-indicating band.

14. The assembly of claim 1, wherein a removable torque for removing the closure from the container is less than 16 inch-pounds.

15. The assembly of claim 1, wherein a removable torque for removing the closure from the container is between about 9 to 10 inch-pounds.

* * * * *